US005873655A

United States Patent [19]

Echeverria

[11] Patent Number: 5,873,655

[45] Date of Patent: Feb. 23, 1999

[54] BULK CONTAINER WITH INTERNAL BAFFLE BANDS

[75] Inventor: Carlos M. Echeverria, Opa Locka, Fla.

[73] Assignee: Marino Technologies, Inc., Opa-Locka, Fla.

[21] Appl. No.: 748,114

[22] Filed: Nov. 13, 1996

[51] Int. Cl.[6] ..... B65D 30/10

[52] U.S. Cl. ..... 383/119; 383/105; 383/903

[58] Field of Search ..... 383/105, 119, 383/903

[56] References Cited

U.S. PATENT DOCUMENTS 5,316,387 5/1994 Polett et al. ..... 383/119
5,328,267 7/1994 Cuddy et al. ..... 383/105 X
5,468,528 11/1995 Schnaars .
5,649,767 7/1997 Nickell et al. ..... 383/105 X

FOREIGN PATENT DOCUMENTS 4115345 11/1992 Germany ..... 383/119

*Primary Examiner*—Jes F. Pascua
*Attorney, Agent, or Firm*—Alvin S. Blum

[57] ABSTRACT

A bulk container bag of flexible fabric is provided with shape retaining flexible fabric strips at the corners to prevent distortion of the filled bag. Each corner is provided with a plurality of shape retaining rectangular strips anchored at their opposed ends to the adjacent side walls and extending across the corner. The strips are mounted one atop the other and spaced apart sufficiently to enable fill material to flow freely in and out of the corners to have complete filling and packing so that the bags will retain their shape even when stacked. The shape of the strips ensure uniform tensile forces on the walls from top to bottom of the strip.

16 Claims, 2 Drawing Sheets

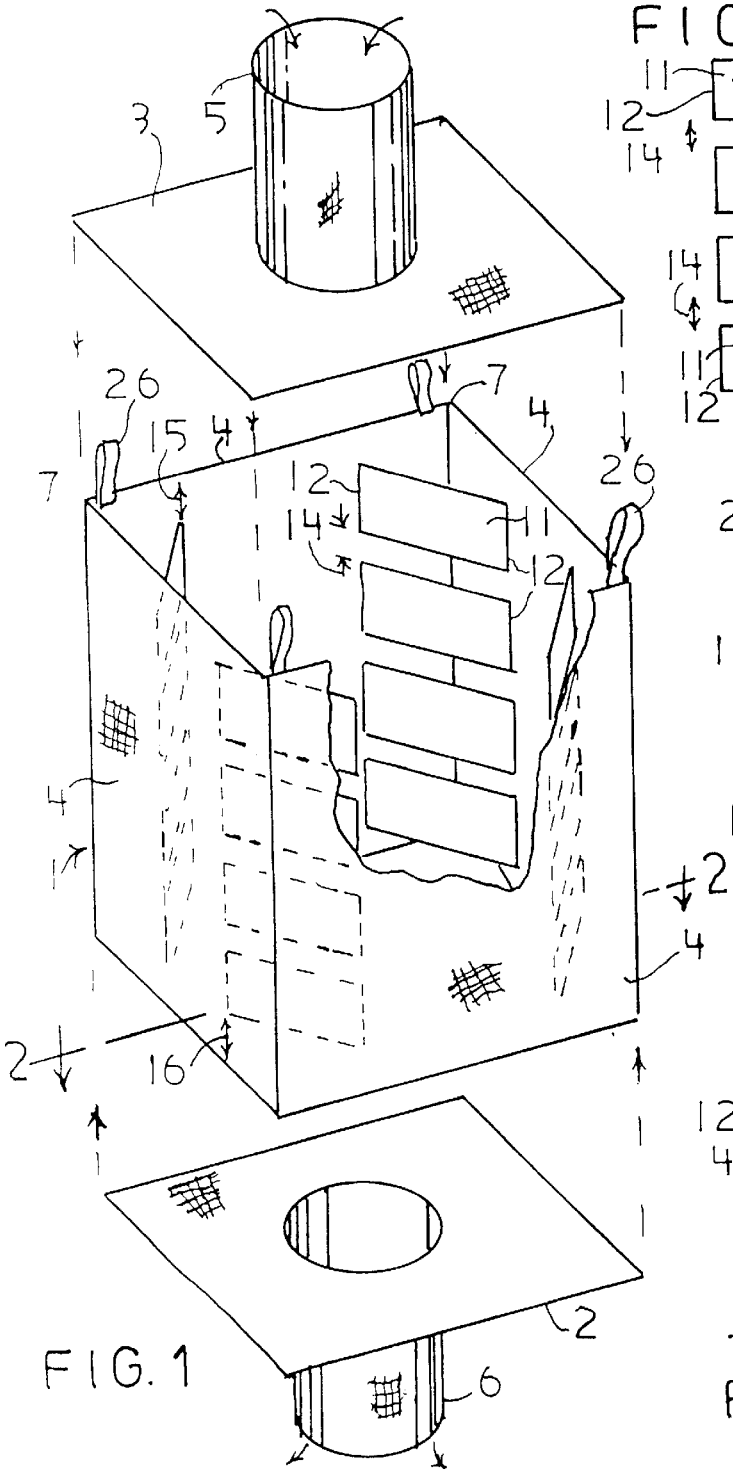
FIG. 1
FIG. 3
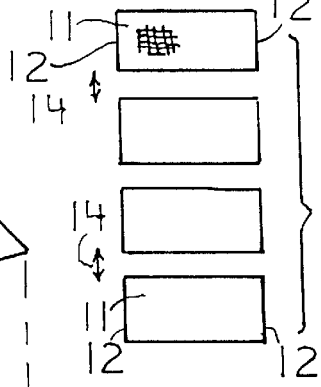
FIG. 4
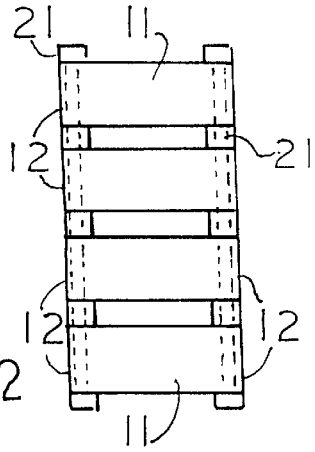
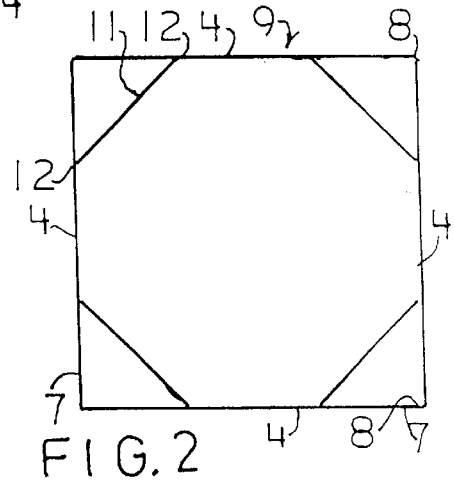
FIG. 2

BULK CONTAINER WITH INTERNAL BAFFLE BANDS

BACKGROUND OF THE INVENTION

This invention relates to flexible bulk containers or bags used for flowable materials, and, more particularly to containers having shape retaining internal baffles.

Flexible bulk containers carrying flowable materials are generally made of fabric in the shape of a cube so that they can be stored, stacked, and transported in a minimal space. However, because the walls are so flexible, the flowable material deforms the walls, forcing them into a more cylindrical shape by bulging the sidewalls and rounding the corners. Various strategies of internal baffling have been employed to overcome this problem. The prior art is most effectively reviewed by U.S. Pat. No. 5,468,528 issued Nov. 21, 1995 to Schnaars et al.. It includes various panels and ropes joining adjacent side walls to restrain their outward bulging. To permit material to flow into and out of the corners enclosed by the baffle panels, various circular, oval, and triangular apertures have been cut in the baffle panels. Unfortunately, these apertures result in irregular stiffening or restraining forces being applied to the side walls as well as irregular packing of the material. This causes bulging of the side walls adjacent the apertures. These irregular bulges increase the packing space required by the filled bags and also cause the bags to lean irregularly, making stacking very unstable. Maintaining the sides of the filled bag as straight as possible is most important not only for shipment and storage, but also in handling the bag for dispensing, for example, when the bag must fit into the dispensing apparatus. At the same time, the addition of effective shape retaining elements should not increase the cost of the bags unnecessarily and should not interfere with effective filling and emptying of the flowable material in all corners of the bags.

SUMMARY OF THE INVENTION

It is, accordingly, an object of the invention to provide bulk bags having internal, shape retaining baffle elements which do not interfere with the flow of materials, that are cost effective, and that maintain the straight side shape of the container more effectively. The bulk bag of the invention comprises a bag of conventional shape and material in which, at each corner of the bag, a plurality of spaced apart bands of fabric are attached to adjacent side walls, forming a plurality of three sided prisms with the side walls at the corner. The spaces between the bands extend uniformly to the side walls to enhance flow of material therethrough for more uniform filling. By packing the flowable material more uniformly in the filled bag, the forces against the side walls are more uniform to thereby ensure straighter sides that are more firmly packed with material for stacking stability. The bands provide uniform tensile forces on the side walls of the packed bag, restraining them against bulging.

By using separate short strips of fabric for the baffles, fabric left over from manufacture of the bags that would ordinarily be scrap or waste may be employed to add considerable improvement at little cost.

These and other objects, advantages and features of the invention will become more apparent when the detailed description is studied in conjunction with the drawings, in which like characters refer to like elements in the various drawing figures.

BRIEF DESCRIPTION OF THE DRAWINGS

FIG. 1 is an exploded perspective view of the bag of the invention with a portion of one side wall broken away.

FIG. 2 is a sectional view taken on line 2—2 of FIG. 1.

FIG. 3 is a front elevation view of the shape retaining strips at one corner of the bag of FIG. 1.

FIG. 4 is a front elevation view of the shape retaining strips at one corner of another embodiment of the invention in which the strips are joined to vertical bands.

DETAILED DESCRIPTION OF PREFERRED EMBODIMENTS

Figure 6:
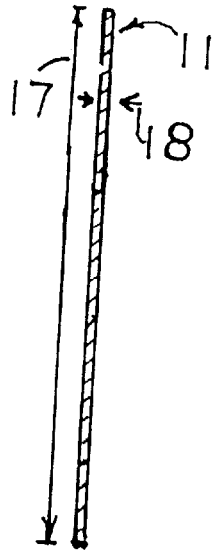
FIG. 6 is a sectional view taken through line 6—6 of FIG. 5.

Referring now first to FIGS. 1–3, a bulk container bag 1 of the invention has the general shape of a cube with a rectangular or square top portion 3 having a fill tube 5 for filling with flowable material and a rectangular or square base portion 2 with a discharge tube 6 for emptying the container. Four vertical side walls 4 join the top and base portions to define the inner chamber having a generally rectangular cross section 9, as best seen in FIG. 2. The side walls may be formed of individual panels joined together or from a length of tubular fabric as is commonly practiced. Lifting loops 26 are provided at the corners 7. The corners 7 formed by the junctions 8 of the side walls 4 form right angles when attached to the top and base portions. Flowable materials pass readily through the fill tube 5 to every corner of the bag. The filling presses the flexible walls outward, causing them to bulge outward to assume a more circular than rectangular shape and interfering with effective packing and stacking of the filled containers. The bag is made of the materials generally used in the art. Woven fabric, preferably polyolefin, is preferred, but other woven and non-woven fabrics and films may be used as well, including plastic film coated woven polyethylene. These materials are deliberately chosen for their strength to withstand the heavy loads they carry, and for their lightness and flexibility for storage when empty. These properties make it difficult to produce a bag that will retain its rectangular shape.

The bag of the invention maintains its shape by the use of the shape retaining fabric strips 11 extending from adjacent side walls 4 across the corner 7 formed by the junction 8 of the side walls. Each strip has a substantially rectangular shape with opposed ends 12. The ends 12 are anchored to the adjacent side walls 4, preferably by stitches. The strips are positioned one atop the other and spaced apart from one another by a distance 14 sufficient to enable fill material to readily flow into and out of the corners. The uppermost strip is spaced apart from the top portion by a distance 15 and the lowermost strip is spaced apart from the base portion by a distance 16. These distances are also selected to be sufficient to enable fill material to readily flow into and out of the corner spaces.

These distances may be as little as one millimeter for very fluid materials and quite large for poorly flowing materials. Distances of 4 to 100 millimeters have been found to be satisfactory for most materials.

The strips are preferably made from the same fabric as the bag, using small pieces that would ordinarily be scrap from the bag making process.

Each strip forms a three sided right prism in combination with the included side walls. This is a substantially rigid structure with the strip forming hypotenuses of right triangles of uniform shape from top to bottom of the strip, so that tensile forces holding the walls against bulging are uniform from top to bottom. This tends to keep the wall straight from top to bottom. The spaces between strips and the top and bottom portions must be maintained to permit free flowing of the fill material. This must be free enough to not only fill, but also to pack the material uniformly so that there will be no tilting of stacked bags. The spaces are kept to a minimum, and will be governed by the flow properties of the particular material.

FIG. 4 shows an alternative arrangement for anchoring the strips to the side walls that may be easier to accomplish in some situations.

Each of the strips 11 for use at one corner are first sewn at their opposed ends 12 to two vertical bands of fabric 21. The assembly is then attached to the bag by sewing the bands 21 to adjacent side walls.

Figure 5:
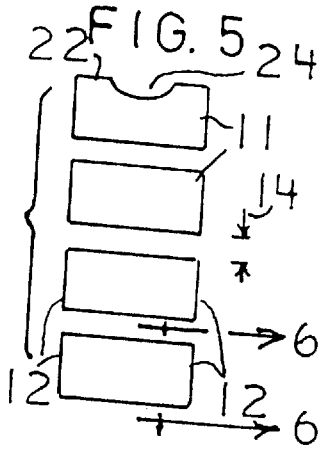
FIG. 5 is a front elevation view of the shape retaining strips at one corner of another embodiment of the invention.

FIG. 5 shows an alternative embodiment of the invention, in which the top edge 22 of the uppermost strip 25 is provided with a central depression 24 to further enhance flow of material.

FIG. 6 shows a shape retaining fabric strip 11 in cross section. The height 17 of the strip is very much greater than its thickness 18, being generally greater by a ratio of at least thirty.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention.

What is claimed is:

1. A bulk container bag for receiving, transporting, storing, and dispensing flowable materials comprising:

a rectangular base portion;

a rectangular top portion;

four vertical side walls joining the base and top portions and forming four right angle corners at the junctions of the side walls to define a chamber having a rectangular cross section, the side walls, base and top portions being of flexible fabric; and a plurality of separate, short, individual, substantially rectangular, flexible fabric strips extending across each corner, each strip having two opposed ends anchored by separate seams to adjacent side walls, the strips applying uniform tensile forces along each said seam to define a stabilized three sided right prism shape with the connected side walls, the strips being disposed one atop the other and spaced apart from one another by a distance of at least four millimeters, and spaced away from the base and top portions by at least four millimeters for free access and egress of flowable materials to the corners while maintaining strightening and stiffening forces on the walls against distortion.

2. The bag according to claim 1, in which the flexible fabric strips have a height to thickness ratio of at least thirty.

3. The bag according to claim 2, in which the ends of the fabric strips are attached directly to the side walls.

4. The bag according to claim 2, in which the ends of all the fabric strips across a corner are attached to vertical bands which are then attached to the side walls.

5. The bag according to claim 1, in which the ends of the fabric strips are attached directly to the side walls.

6. The bag according to claim 1, in which the ends of the fabric strips are attached to vertical bands which are then attached to the side walls.

7. The bag according to claim 1, in which the uppermost strips have an upper edge provided with a centrally located depression for enhanced movement of flowable material.

8. The bag according to claim 2, in which the uppermost strips have an upper edge provided with a centrally located depression for enhanced movement of flowable material.

9. A bulk container bag for receiving, transporting, storing, and dispensing flowable materials comprising:

a rectangular base portion;

a rectangular top portion;

four vertical side walls joining the base and top portions and forming four right angle corners at the junctions of the side walls to define a chamber having a rectangular cross section, the side walls, base and top portions being of flexible fabric; and a plurality of separate, short, individual, substantially rectangular, flexible fabric strips extending across each corner, each strip having two opposed ends anchored by separate seams to adjacent side walls, the strips applying uniform tensile forces along each said seam to define a stabilized three sided right prism shape with the connected side walls, the strips being disposed one atop the other and spaced apart from one another by a distance of at least one millimeter, and spaced away from the base and top portions by at least one millimeter for free access and egress of flowable materials to the corners while maintaining strightening and stiffening forces on the walls against distortion.

10.The bag according to claim 9, in which the flexible fabric strips have a height to thickness ratio of at least thirty.

11. The bag according to claim 10, in which the ends of the fabric strips are attached directly to the side walls.

12. The bag according to claim 10, in which the ends of all the fabric strips across a corner are attached to vertical bands which are then attached to the side walls.

13. The bag according to claim 9, in which the ends of the fabric strips are attached directly to the side walls.

14.The bag according to claim 9, in which the ends of the fabric strips are attached to vertical bands which are then attached to the side walls.

15. The bag according to claim 9, in which the uppermost strips have an upper edge provided with a centrally located depression for enhanced movement of flowable material.

16. The bag according to claim 10, in which the uppermost strips have an upper edge provided with a centrally located depression for enhanced movement of flowable material.

* * * * *